US006667584B2

(12) United States Patent
Hooijer et al.

(10) Patent No.: US 6,667,584 B2
(45) **Date of Patent: *Dec. 23, 2003**

(54) SHORT CIRCUIT BALLAST PROTECTION

(75) Inventors: Christofher Daniel Charles Hooijer, Eindhoven (NL); Wilhelmus Hinderikus Maria Langeslag, Nijmegen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 10/270,964

(22) Filed: Oct. 15, 2002

(65) Prior Publication Data

US 2003/0076055 A1 Apr. 24, 2003

(30) Foreign Application Priority Data

Oct. 18, 2001 (EP) ..... 01203980

(51) Int. Cl.[7] ..... H05B 41/16; H05B 37/02

(52) U.S. Cl. ..... 315/224; 315/291

(58) Field of Search ..... 315/58, 224, 291, 315/209 R, 307; 313/493, 113 A

(56) References Cited

U.S. PATENT DOCUMENTS 5,982,110 A * 11/1999 Gradzki ..... 315/247
6,043,611 A * 3/2000 Gradzki et al. ..... 315/194
6,181,086 B1 * 1/2001 Katyl et al. ..... 315/307
6,459,215 B1 * 10/2002 Nerone et al. ..... 315/291

* cited by examiner

*Primary Examiner*—Don Wong
*Assistant Examiner*—Minh D A

(57) ABSTRACT

A fluorescent lamp preheating circuit heats electrodes prior to lamp ignition while utilizing a sense resistor to detect and correct short-circuit conditions caused by improper wiring. The circuit uses few components, each of which is independent of parameters such as switching frequency, duty-cycle, and filament resistance, and is therefore compact, cost-effective, and efficient. The preheating circuit can be switched off when the electrodes are warmed sufficiently in order to conserve energy and prevent thermal overload, or when short-circuit conditions are encountered.

7 Claims, 2 Drawing Sheets

SHORT CIRCUIT BALLAST PROTECTION

FIELD OF THE INVENTION

The present invention relates generally to circuitry for protecting a ballast from short circuit currents.

BACKGROUND OF THE INVENTION

An electronic ballast typically provides a rectified line voltage through a Power Factor Correction (PFC) circuit to an inverter such as a half-bridge circuit, and the inverter then converts the direct voltage into a high-frequency alternating voltage for driving a fluorescent gas discharge lamp. To maximize the effective life (which is reduced with each cold start) of a fluorescent lamp, it is known to provide a "rapid-start" preheating circuit within the electronic ballast. The heater windings of the preheating circuit warm a filament within the fluorescent lamp (normally by providing a controlled current or a controlled voltage) before the lamp is switched on. As in low-frequency hybrid ballast technologies, it is also known to provide "modified rapid-start" circuitry that disconnects cathode heater windings after the lamp ignites, thereby reducing the energy consumed per lamp during steady-state conditions.

The proper wiring configuration between the input power line and the lamp driven by a ballast is determined by the type of lamp that the ballast will drive. If the fixture is improperly wired a short circuit of the lamp terminals will occur, which leads to damage within the ballast and/or the lamp manifested by reduced lamp life, failure of the lamp to ignite, and/or premature failure of the ballast.

Known short circuit proofing approaches are relatively costly and typically rely on parameters such as switching frequency or component tolerances, thereby making the design rigid. For example, a frequency dependent filament heating circuit may employ filament voltage oscillators and a detector circuit for each filament to control filament voltage during an interrupt or fault condition. In this circuit arrangement, the filament voltage oscillators are separate from and operate independently of an arc voltage oscillator. Furthermore, any short circuit protection scheme for a universal ballast (i.e., a ballast that can drive different lamp types) that uses frequency-dependent components must be designed to achieve a stable and accurately controlled filament voltage. Such a design is complicated by the fact that filament impedances typically vary according to lamp type. Thus, such an approach is disadvantageous due at least in part to the cost of the more rigid development process.

Over-current protection can also be provided using a silicon controlled rectifier and a zener diode. When the output current increases to the maximum value and the voltage across the zener diode reaches its breakdown voltage, the zener diode charges a capacitor that eventually fires the rectifier which then disables the oscillation control circuit. Thus, because this approach also depends on the tolerances of both the zener diode and the rectifier it is relatively costly to design.

There is a need for an improved and less expensive configuration of a preheating circuit that includes protection against short circuits caused by improper wiring and that is independent of switching frequency and component tolerances.

SUMMARY OF THE INVENTION

The circuit of the present invention fulfills the need described above by providing a preheating circuit that warms lamp electrodes in a relatively short time, produces an accurate filament voltage, and that operates independently of switching frequency of the inverter, duty-cycle of the switch(es) in the inverter, filament resistance or other similar parameters. Furthermore, the circuit is short-circuit proof, cost-effective, and compact. The preheating circuit includes a sense resistor to detect and prevent damage caused by short circuit conditions. In the event that a short circuit occurs, the voltage across the sense resistor acts as a control signal that switches the preheating circuit off. The exemplary short-circuit protection circuit configuration of the present invention has the advantage of being simple to design because it is practically independent of the switching frequency and tolerances of the ballast components.

Briefly, the present invention provides a preheating circuit as a rapid-start mechanism to preheat the electrodes of a fluorescent lamp before the required voltage for striking an arc between the electrodes is applied. An exemplary circuit according to the present invention heats the electrodes through a transformer, comprising a primary winding and two secondary windings, and a small sensing resistor connected in series with the primary winding and fed by a voltage source such as a half-bridge circuit. The sensing resistor functions such that a short circuit will cause the voltage across the resistor to exceed a predetermined level which triggers switching the voltage source off. This electrode heating circuit can be used in a multi-lamp ballast, as the circuit enables such a ballast to withstand individual short-circuits that can occur randomly between lamps driven by the ballast.

A further exemplary embodiment of the present invention is a ballast circuit that is connected to two fluorescent lamps, each lamp having two ends with a filament at each end, and each filament connected to an electrode. The ballast circuit includes a half-bridge circuit that supplies voltage to a preheating circuit which preheats the electrodes of each lamp driven by the ballast. The preheating circuit includes a filament heating transformer that has a primary winding and three secondary windings. The primary winding is connected in series with a relatively large capacitor that performs DC-blocking (i.e., removes DC voltage bias from the supply voltage). The ballast circuit also includes a short-circuit protection circuit that detects elevated currents in the primary winding of the preheating circuit, a condition which indicates the presence of a short-circuit of at least one secondary winding of the preheating circuit. The short-circuit protection circuit utilizes a sensing resistor that is coupled to the preheating circuit to sense the current flowing through the primary winding preheating circuit. The sensed current is converted into a rectified average DC voltage (which is used as a control signal) by a control signal circuit that is connected across the sensing resistor. The control signal circuit is the combination of a rectifying diode and a low-pass filter that ensures that transitory currents (e.g., inrush and start-up currents) do not trigger the disengagement of the preheating circuit. Rather, a control means (for example, a MOSFET) connected between the preheating circuit and the sensing resistor operates to disengage the supply voltage if non-transitory overcurrent conditions occur such that the control signal exceeds the value of a preset trigger level. A clamping diode prevents the voltage across the MOSFET from exceeding the bus voltage.

Filament sensing is performed by some ballasts. Accordingly, in an alternative embodiment, the ballast circuit includes a capacitor and a circuit part for generating a DC current through one or more lamp filaments and for detecting that DC-current. The capacitor blocks a path of the DC current that does not comprise the lamp filaments but one of the secondary windings of the filament heating transformer in the event that the filament sensing circuit determines that a lamp filament is not present. The DC current path is interrupted if a filament is missing or otherwise cannot conduct. This interruption is detected and the ballast circuit can for instance be switched off.

An advantage of the preheating circuit according to this exemplary ballast circuit is that the filament heating transformer can be relatively small in size because the filament heating transformer needs only to carry a current during startup of the ballast (while the lamp electrodes are heated), and can be switched off during normal operation.

Additional objects, advantages and novel features of the invention will be set forth in part in the description which follows, and in part will become more apparent to those skilled in the art upon examination of the following, or may be learned by practice of the invention.

BRIEF DESCRIPTION OF THE DRAWINGS

The accompanying drawings, which are incorporated in and form part of the specification, illustrate the present invention when viewed with reference to the description, wherein.

DETAILED DESCRIPTION OF THE EMBODIMENTS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
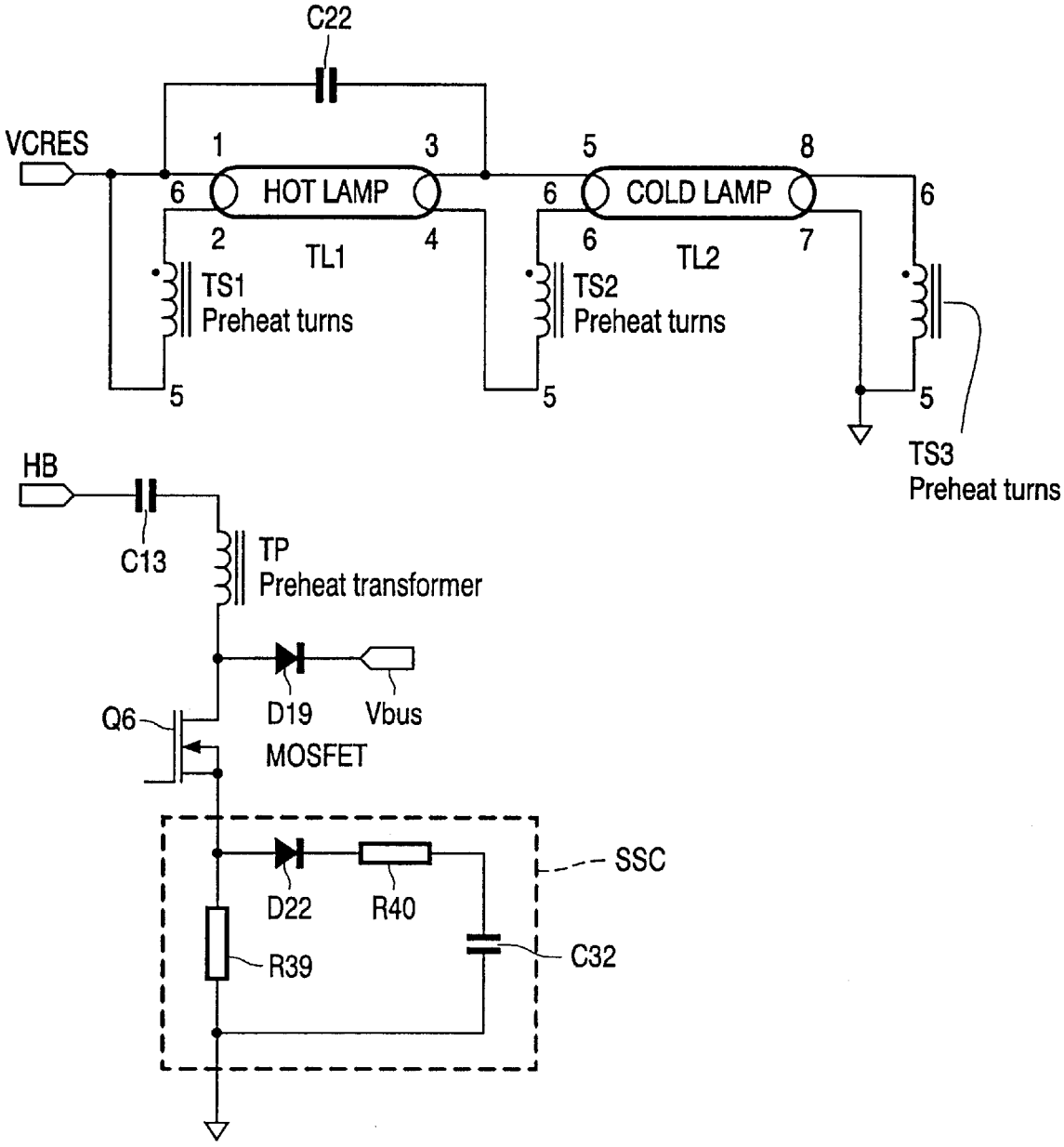
FIG. 1 is a circuit diagram of part of an embodiment of a ballast circuit according to the invention and with two lamps connected to it.

FIG. 1 is a circuit diagram of part of an exemplary ballast circuit for operating two lamps in series according to an embodiment of the present invention. The exemplary ballast circuit includes a preheating circuit and a short-circuit protection circuit. According to an alternative embodiment shown in FIG. 2, the ballast circuit has no filament-sensing components.

Preheating Circuit

Referring to FIG. 1, the preheating circuit includes a transformer T with a primary winding TP, a first secondary winding TS1, a second secondary winding TS2, and a third secondary winding TS3. A half-bridge circuit supplies voltage at pin HB that feeds the primary winding TP of the transformer T, thereby inducing currents through each of the secondary windings TS1, TS2, and TS3 that serve to heat the electrodes of the lamps TL1 and TL2 driven by the ballast (not shown). MOSFET Q6 is controlled by the half-bridge driver, and operates as a switch to enable the preheating circuit when power is applied, and to disable the preheating circuit when the preheating time is over (i.e., the electrodes are sufficiently heated for ignition). Diode D19 clamps the voltage across MOSFET Q6 approximately at the DC bus voltage Vbus. Capacitor C13 performs DC blocking.

Short Circuit Protection

Referring again to FIG. 1, the short-circuit protection circuit SSC of the exemplary embodiment of the present invention is provided by a sensing resistor R39, a resistor R40, a diode D22, and a capacitor C32. In the event of a short-circuit between the ends of a secondary winding an increased current flows through said secondary winding (TS1, TS2, or TS3) of the filament heating transformer T. This increased current also translates to the primary side TP of the filament heating transformer T and is magnified according to the winding ratio n1/n2. This higher current is sensed by the sensing resistor R39 which is connected in series with the filament heating transformer T, and is converted to a rectified average DC voltage via the diode D22, the resistor R40 and the capacitor C32. When the voltage on capacitor C32 reaches a trigger level the half-bridge is immediately switched off, thereby protecting the ballast against excessive circulating short-circuit currents and the associated undesirable temperature rise in the ballast components. The trigger level is defined by half-bridge inverter driver integrated circuit (IC) which typically includes an output "disable" function.

Filament Sensing Configuration

Figure 2:
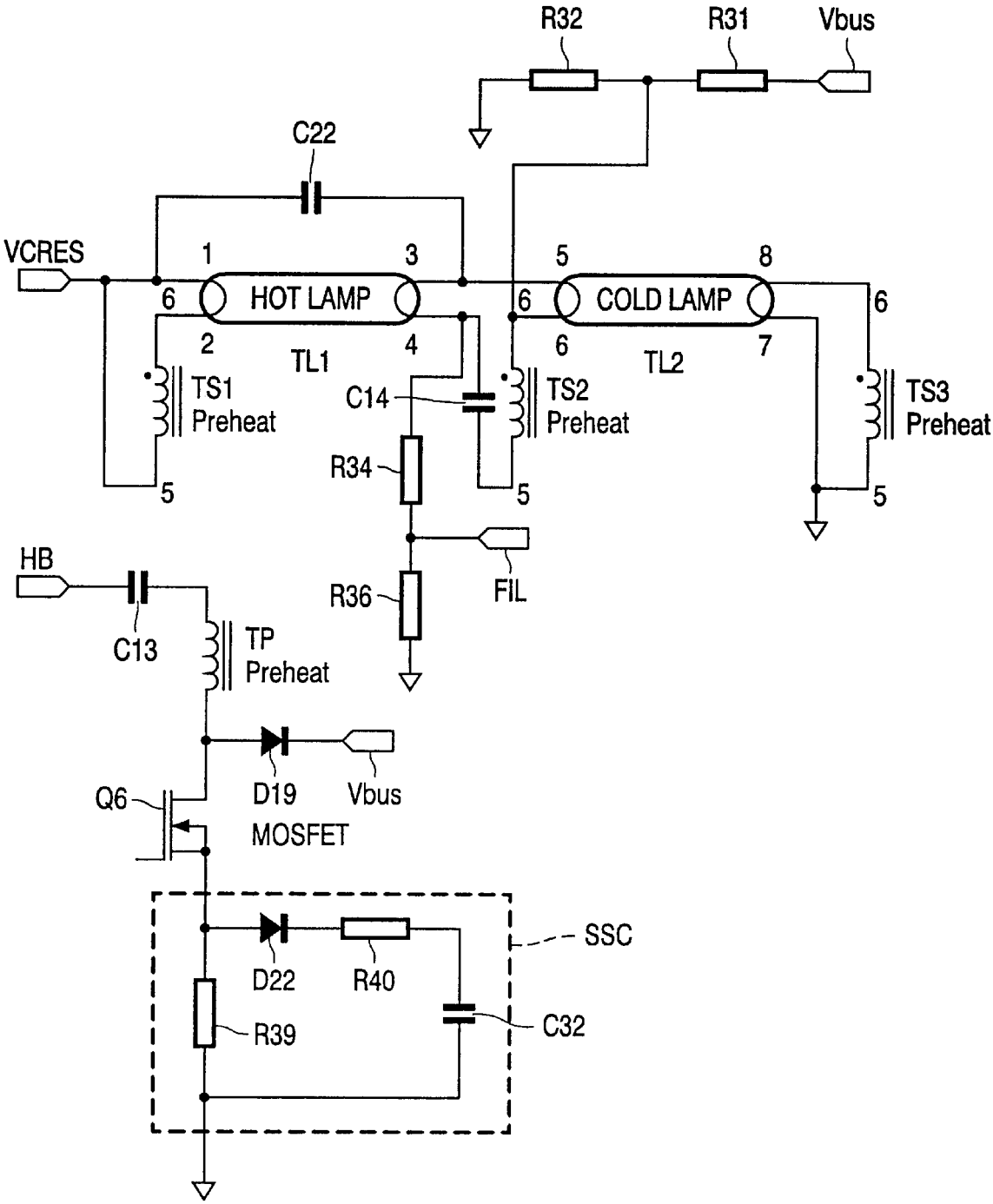
FIG. 2 is a circuit diagram of part of an embodiment of a ballast circuit according to the invention with filament sensing components and with two lamps connected to it.

The exemplary circuit shown in FIG. 2 further includes filament sensing components (capacitor C14, and resistors R31, R32, R34, and R36). The capacitor C14 blocks a DC current path through secondary winding TS2. Thus, if one lamp filament is destroyed or removed a break in the DC current path through a lamp filament of lamp TL1 and a lamp filament of lamp TL2 and resistors R31, R34 and R36 is effected such that current cannot continue to flow. Such a break is detected at the pin FIL, and the half-bridge control IC shuts the ballast down. Restoration of continuity in the series arrangement of the lamp filaments and the resistors (i.e., replacement of the damaged or removed lamp) is also detected at the pin FIL, and the ballast is restarted. Thus, lamp maintenance can be accomplished without disconnecting the main supply voltage.

In view of the foregoing, it will be appreciated that the present invention provides a system for accurate, efficient, and cost-effective electrode heating with detection and correction of short-circuit conditions. Still, it should be understood that the foregoing relates only to the exemplary embodiments of the present invention, and that numerous changes may be made thereto without departing from the spirit and scope of the invention as defined by the following claims.

What is claimed is:

1. A ballast circuit adapted to be connected to at least one fluorescent lamp, each lamp having two ends with a filament at each end, each filament connected to a lamp electrode, further comprising:

a circuit part for generating a supply voltage;

a preheating circuit powered by the supply voltage, configured to preheat the lamp electrodes;

a protection circuit, configured to detect short-circuit conditions in the preheating circuit, and comprising:

a sensing resistor coupled to the preheating circuit, configured to sense a current flowing through the preheating circuit;

a control signal circuit connected across the sensing resistor, configured to convert the sensed current into a control signal, comprising a low-pass filter, configured to prevent transitory currents from triggering a control means; and a rectifying diode;

the control means connected between said preheating circuit and the sensing resistor, configured to disable the supply voltage when the control signal exceeds the value of a preset trigger level.

2. The circuit of claim 1, wherein said control means is a transistor.

3. The circuit of claim 2, wherein the transistor is a MOSFET.

4. The circuit of claim 3, further comprising a clamping diode configured to maintain a voltage across the MOSFET substantially at a bus voltage.

5. The circuit of claim 1, wherein the control signal is a rectified average DC-voltage.

6. The circuit of claim 1, wherein the preheating circuit comprises:

a filament heating transformer including a primary winding and at least two secondary windings; and a DC blocking capacitor connected in series with the filament heating transformer, configured to remove DC voltage bias from the supply voltage.

7. The circuit of claim 6, further comprising:

a filament sensing circuit, configured to detect the absence of a lamp filament;

a capacitor positioned in series with one of the secondary windings of the filament heating transformer to prevent current flow through the secondary winding when the absence of a lamp filament is detected.

* * * * *